US005445136A

United States Patent [19]

Yamashita et al.

[11] Patent Number: 5,445,136

[45] Date of Patent: Aug. 29, 1995

[54] AIR-FUEL RATIO CONTROL APPARATUS FOR INTERNAL COMBUSTION ENGINES

[75] Inventors: Yukihiro Yamashita, Kariya; Toshihiro Suzumura, Nagoya, both of Japan

[73] Assignee: Nippondenso Co., Ltd., Kariya, Japan

[21] Appl. No.: 248,951

[22] Filed: May 25, 1994

[30] Foreign Application Priority Data

Jun. 25, 1993 [JP] Japan ..... 5-155644
Jun. 25, 1993 [JP] Japan ..... 5-155646

[51] Int. Cl.[6] ..... F02D 41/14
[52] U.S. Cl. ..... 123/689
[58] Field of Search ..... 123/689, 682, 695, 687, 123/493; 364/431.07, 431.04, 431.05

[56] References Cited

U.S. PATENT DOCUMENTS

| | | | |
|---|---|---|---|
| 4,203,394 | 5/1980 | Aono et al. | 123/689 |
| 5,103,791 | 4/1992 | Tomisawa | 123/689 |
| 5,178,121 | 1/1993 | Kitajima et al. | 123/689 |
| 5,184,588 | 2/1993 | Kato et al. | 123/339 |
| 5,243,952 | 9/1993 | Ikuta et al. | 123/682 |
| 5,253,630 | 10/1993 | Akazaki et al. | 123/689 |

FOREIGN PATENT DOCUMENTS

| | | |
|---|---|---|
| 59-7754 | 1/1984 | Japan . |
| 60-27749 | 2/1985 | Japan . |
| 62-248848 | 10/1987 | Japan . |
| 63-195355 | 8/1988 | Japan . |
| 312835 | 4/1989 | Japan . |
| 1219327 | 9/1989 | Japan . |

*Primary Examiner*—Raymond A. Nelli
*Attorney, Agent, or Firm*—Cushman, Darby & Cushman

[57] ABSTRACT

For stable air-fuel ratio control without hunting, an output condition of an air-fuel ratio sensor is monitored to decide whether or not a modern or advanced control using a dynamic model may be performed. The appropriateness of using the dynamic model may be determined by monitoring whether the output value of an air-fuel ratio sensor exists in a predetermined range or whether the air-fuel ratio sensor is maintained stably in an air-fuel ratio detectable state. When the sensor output condition is out of the predetermined range suitable for the modern control, an optimum feedback gain for performing the modern control is switched over to a lowered gain or the modern control is switched over into normal feedback control by proportional-and-integral control. By this control mode switch-over, most appropriate air-fuel ratio feedback control may be performed.

8 Claims, 13 Drawing Sheets

AIR-FUEL RATIO CONTROL APPARATUS FOR INTERNAL COMBUSTION ENGINES

BACKGROUND OF THE INVENTION

1. Field of the Invention

The present invention relates to an air-fuel ratio control apparatus for controlling a quantity of fuel supplied into an internal combustion engine to control an air-fuel ratio of an air-fuel mixture toward a target air-fuel ratio, and more particularly to an apparatus for assuring more stable control operation of a feedback system for controlling the air-fuel ratio of the internal combustion engine.

2. Description of Related Art

As an air-fuel ratio control apparatus of this kind, conventionally, there is an apparatus which is disclosed in for instance a Japanese laid-open patent publication No. 1-110853. Namely, in this apparatus a so-called modern control theory is also utilized in which taking basically into account the dynamic model of a system for controlling an air-fuel ratio of an internal combustion engine, a quantity of fuel to be supplied on each occasion is feedback-controlled under an optimal gain wherein an internal state of the model is estimated. In such a modern control theory, construction of a state observing instrument called as an observer is generally needed, and its control quantity and control scale become enormous. In view of this reason, especially in this apparatus air-fuel ratio control means is constructed by the dynamic model of the internal combustion engine for determining an air-fuel ratio, approximating a dead-time by an auto-regressive model whose model order is 1 and further taking into account the disturbance. The the apparatus is provided with: a state variable quantity output part for outputting an air-fuel ratio of the internal combustion engine and a control quantity of fuel supply quantity control means as a state variable quantity representing the internal state of the dynamic model of the internal combustion engine; an accumulation part for accumulating a deviation between a target air-fuel ratio and an actual detected air-fuel ratio; and a control quantity calculation part for calculating a control quantity of a fuel supply quantity control means from an optimal feedback gain predetermined based on the dynamic model, the state variable quantity and the accumulated value by the accumulation part. Accordingly, this makes such an observer unnecessary.

In such construction the aforementioned model must be always constructed with a dynamic model which exactly satisfies a relation between a fuel supply quantity to the internal combustion engine and an air-fuel ratio of the air-fuel mixture.

In an air-fuel ratio sensor constructing the aforementioned air-fuel ratio detection means, however, there is in general a tendency that an output at the rich side is difficult to be produced as compared with an output at the lean side. Accordingly, there is a possibility that the above-mentioned model relationship is changed in these ranges, that is, concretely in ranges wherein the sensor outputs may not take a linear value. If the dynamic model relationship is thus changed, overcorrection or correction shortage is caused by a deviation between the actual air-fuel ratio and the aforementioned detected air-fuel ratio, and besides there is a possibility of hunting being caused.

In addition, such an air-fuel ratio sensor has a state that an output of the air-fuel ratio sensor changes slowly with respect to oxygen concentration of the exhaust gas and a state that the output changes rapidly with predetermined oxygen concentration bordered. In view of this fact, in an air-fuel ratio control apparatus disclosed in for instance a Japanese laid-open patent publication No. 62-248848, a predetermined value is compared with a difference between outputs of the air-fuel ratio sensor corresponding respectively to the actual air-fuel ratio and a target air-fuel ratio to switch over an output state of the air-fuel ratio sensor. Then, feedback control of the air-fuel ratio is performed on a basis of a relative output state (a state in which an electric voltage is applied across electrodes) of the same sensor until the detected result becomes substantially stable. After the detected result has stabilized, feedback control of the air-fuel ratio is performed on a basis of an output in the rapidly changing output condition (a state in which the electric voltage is not applied across the electrodes) of the same sensor. In this case, however, there is still no change in the fact that an output at the rich side of the air-fuel ratio sensor is difficult to be produced as compared with an output at the lean side. Especially at the rich side, therefore, it is also doubtful whether or not the output of the aforementioned relative output state itself correlates exactly with oxygen concentration of the exhaust gas. If such correlation has been changed, the control performed based on the detected output of the air-fuel ratio becomes also low in its reliability naturally. This is likely to cause hunting in an extreme case.

In addition to the aforementioned problems, an oxygen concentration sensor which ordinarily generates a rich output or a lean output is activated at about 300° C., while in an air-fuel ratio sensor constructing the aforementioned air-fuel ratio detection means a rich/lean output corresponding to a limiting electric current or output of the air-fuel ratio sensor is initiated at 400° C. Usually, the air-fuel ratio sensor must be used at temperature wherein the limiting current is stabilized. The element temperature of about 630° C. is thus needed for measuring the air-fuel ratio over a range till the temperature reaches 400° C. Accordingly, it is impossible to start feedback of the air-fuel ratio till the element temperature reaches about 630° C. As a result, the starting timing of the feedback is delayed considerably as compared with normal feedback of the air-fuel ratio given by the oxygen concentration sensor, and the drawback occurs that HC in the exhaust gas becomes bad.

As a countermeasure, proposed is a method that when the limiting electric current starts to be produced, the feedback is started at once. However, the output characteristic of the air-fuel ratio sensor does not stabilize in a semi-warming up state of the above-mentioned air-fuel ratio sensor. Accordingly, the dynamic model relationship between the fuel injection quantity and the air-fuel ratio is changed. As a result, there occurs the drawback that control of the air-fuel ratio expected by use of the modern control theory may not be realized properly. Especially, in the air-fuel ratio control apparatus of the aforementioned construction, the air-fuel ratio control becomes unstable increasingly due to high responsibility. Thus, there is a possibility of hunting phenomena.

In view of such an output characteristic of the air-fuel ratio sensor, there is an apparatus which determines whether or not an air-fuel ratio sensor is maintained in a stable state. Then, feedback control of an air-fuel ratio based on an output of the air-fuel ratio sensor is performed if the air-fuel ratio sensor is maintained in the stable state, whereas quasi-data stored in advance in a memory is substituted for the control if the air-fuel ratio sensor is maintained in an unstable state (refer to a Japanese laid-open patent publication No. 1-219327). Furthermore, there is an apparatus which determines whether or not the air-fuel ratio sensor is maintained in a stable state likewise. Then, feedback control is performed so as to make the actual air-fuel ratio a desired air-fuel ratio except the stoichiometric or theoretical air-fuel ratio if the air-fuel ratio sensor is maintained in the stable state, whereas the feedback control is performed so as to make the actual air-fuel ratio the stoichiometric air-fuel ratio if the air-fuel ratio sensor is maintained in an unstable state (refer to a Japanese laid-open patent publication No. 60-27749. However, there is room for further improvement in these apparatuses from a point of view of flexibility along an internal condition of the actual control system and responsiveness (a converging speed) of a feedback system.

SUMMARY OF THE INVENTION

In view of such actual circumstances, it is, therefore, an object of the present invention to provide an air-fuel ratio control apparatus of an internal combustion engine capable of maintaining stable feedback control causing no hunting and the like by monitoring output condition of an air-fuel ratio sensor and switching over control mode in response to the monitored output condition, even if normal maintenance regarding dynamic model relationship between a fuel injection quantity to the internal combustion engine and an air-fuel ratio of an air-fuel mixture is not desired or expected.

For attaining such an object, the first aspect of the invention is, as shown in FIG. 7, intended to an air-fuel ratio control apparatus for an internal combustion engine M1 having fuel supply means M2 for supplying fuel into air sucked into the same internal combustion engine so as to form fan air-fuel mixture to be supplied to the internal combustion engine M1, air-fuel ratio detection means M3 for detecting an air-fuel ratio of the air-fuel mixture on a basis of exhaust gas of the internal combustion engine M1, air-fuel ratio control means M4 for obtaining an air-fuel ratio correction coefficient required on each occasion as it performs feedback for controlling the detected air-fuel ratio toward a target air-fuel ratio on a basis of a control model set in approximation with a controlled object from the fuel supply means M2 to the air-fuel ratio detection means M3, fuel supply quantity control means M5 for controlling a fuel quantity, on a basis of the obtained air-fuel ratio correction coefficient, which the fuel supply means M2 supplies.

The control apparatus comprises: detected value determination means M6 for monitoring a detected value of the air-fuel ratio detected by the air-fuel ratio detection means M3 and for determining whether or not the detected value exists in a predetermined range wherein the set control model may be maintained; wherein the air-fuel ratio control means M4 obtains the air-fuel ratio correction coefficient as it performs the feedback at a low gain for converging the feedback slowly, when the detected value determination means M6 determines that the detected value is out of the predetermined range.

With this construction, assuming that the dynamic relationship is exactly satisfied between the fuel injection quantity to the internal combustion engine M1 and the air-fuel ratio of the air-fuel mixture, it is recognized whether or not the satisfied dynamic model relationship is normally maintained, by monitoring through the detected value determination means M6 whether or not the detected value of the air-fuel ratio from the air-fuel ratio detection means M3 exists in the predetermined range. That is, if the detected value from the air-fuel ratio detection means M3 has only to exist in the predetermined range in which the set control model may be maintained, it is possible to determine that such dynamic model relationship is also normally maintained at least in its point of time. Conversely, in case the detected value of the same air-fuel ratio is out of the predetermined range, such dynamic model relationship is not necessarily maintained normally. Accordingly, if the converging speed of the feedback system is slowed actively down under the decision that the air-fuel ratio detected value from the air-fuel ratio detection means M3 is out of the predetermined range, as described above, overcorrection or correction shortage caused by the same feedback is restrained naturally. Even if maintenance of the aforementioned model relationship is not appropriate or desired, generation of hunting or the like caused by it becomes well prevented. Furthermore, such feedback given by slowing down the converging speed is performed only when the detected value of the air-fuel ratio is deviated from the aforementioned predetermined range. Consequently, this may not lower responsiveness or response characteristics as the whole control apparatus.

In addition, for instance a range wherein the detected value of the air-fuel ratio detection means M3 may take a linear value may be determined as the predetermined range which the detected value determination means M6 monitors. The range which the detected value of the air-fuel ratio detection means M3 may take a linear value is determined experimentally in advance on a basis of an electric voltage-electric current characteristic or the like of the used air-fuel ratio detection means to an air-fuel ratio. The detected value determination means M6 here has only to merely monitor whether the detected value of the air-fuel ratio detected by the air-fuel ratio detection means M3 exists in the range or not.

In case of the apparatus, further, a feedback method performed through the air-fuel ratio control means M4, that is, a calculation method of the aforementioned air-fuel ratio correction coefficient is optional. For instance, the following methods are considered.

(a) In a normal state wherein a detected value of the air-fuel ratio exists in the aforementioned predetermined range, obtained is a correction coefficient corresponding to a target air-fuel ratio set in accordance with a state of the internal combustion engine on each occasion while high speed state feedback by the modern control theory is performed. When the detected value of the air-fuel ratio is deviated from the predetermined range, a feedback gain of the state feedback is lowered.

(b) In a normal state wherein a detected value of the air-fuel ratio exists in the aforementioned predetermined range, obtained likewise is a correction coefficient corresponding to a target air-fuel ratio set in accordance with a state of the internal combustion engine on each occasion while high speed state feedback by the modern control theory is performed. When the detected value of the air-fuel ratio is deviated from the predetermined range, proportional/integral control is performed with the target air-fuel ratio determined in a specified value.

Furthermore, the second aspect of the invention is, as shown in FIG. 13, intended to an air-fuel ratio control apparatus for an internal combustion engine having air-fuel ratio control means M4a for obtaining an air-fuel ratio correction coefficient required on each occasion as it performs state feedback for controlling the detected air-fuel ratio toward a target air-fuel ratio on a basis of a control model set in approximation with a controlled object from the fuel supply means M2 to the air-fuel ratio detection means M3. The control apparatus comprises: determination means M6a for determining whether or not the air-fuel ratio detection means M3 is maintained stably in an air-fuel ratio detectable state; memory means M7 for setting and storing therein, as the control model, optimal feedback gains for converging the state feedback most quickly, corresponding to respective states when the air-fuel ratio detection means M3 is maintained stably in the air-fuel ratio detectable state and is not maintained so; and control model switch-over means M8 for selectively reading out these set and stored optimal feedback gains in accordance with the determined result of the determination means M6a. And the air-fuel ratio control means M4a obtains the air-fuel ratio correction coefficient on a basis of the optimal feedback gain read out selectively from the control model switch-over means MS.

The optimal feedback gains which are set and stored respectively into the memory means M7 as the control model, namely the first and second control models are gains for converging most quickly the state feedback and obtained in advance experimentally, corresponding to respective states of the state feedback applied actually when the air-fuel ratio detection means M3 is maintained stably in the air-fuel ratio detectable state and is not maintained so.

Accordingly, that these first and second control models (optimal feedback gains) are selectively read into the air-fuel ratio control means M4*a* in accordance with the determined result of the determination means M6*a* means that calculation of the air-fuel ratio correction coefficient based on the dynamic relationship between the supplied fuel quantity and the detected air-fuel ratio is performed in most conformity with a state of the air-fuel ratio detection means M3 on each occasion. As the result, it becomes possible in any cases to suitably maintain the air-fuel ratio feedback control based on the aforementioned modern control theory which is rich in flexibility and excellent in response characteristics.

In addition, as a determination method by the determination means M6, there is, for instance, a method in which: (a) the fact that the air-fuel ratio detection means M3 is maintained stably in the air-fuel ratio detectable state is determined on a basis of a logic product condition between that a temperature of the air-fuel ratio detection means M3 reaches a predetermined temperature and that a predetermined time lapses after reach of the temperature to the predetermined temperature; or (b) the fact that the air-fuel ratio detection means M3 is maintained stably in the air-fuel ratio detectable state is determined under a condition that dynamic relationship between the controlled fuel supply quantity and the detected air-fuel ratio is maintained. In any case, it becomes possible to perform highly reliable determination regarding the stable/unstable state, as compared with a method for merely detecting a temperature of the air-fuel ratio detection means M3 to determine the stable/unstable state.

DETAILED DESCRIPTION OF THE PREFERRED EMBODIMENTS

Hereinafter, preferred embodiments will be explained in which air-fuel ratio control apparatuses for internal combustion engines in accordance with the present invention are applied respectively to a four-cylinder four-cycle spark ignition type internal combustion engine E and its fuel injection control system.

Figure 1:
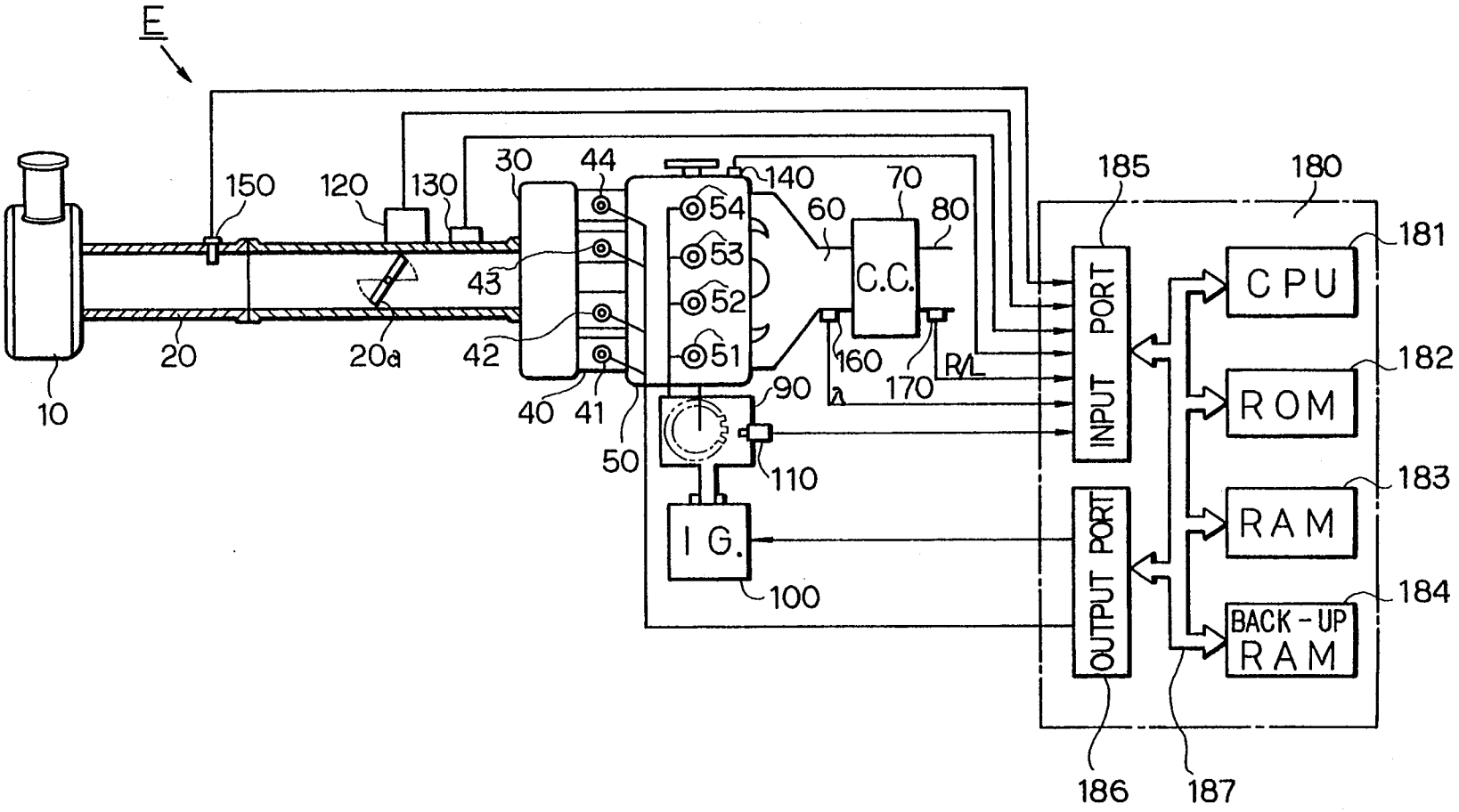
FIG. 1 is a block diagram illustrating an example of construction of an internal combustion engine and its fuel injection control system to which an embodiment of the invention is applied.

In FIG. 1 illustrating a preferred embodiment of the invention, the internal combustion engine E makes an air stream flowing through an air cleaner 10 into an intake pipe 20 flow into an intake manifold 40 through a throttle valve 20*a* within the intake pipe 20 and a surge tank 30 under its operation. Then, this air stream is mixed with fuel which is supplied from a fuel tank (not shown) under pressure and injected through fuel injection valves 41 through 44 and in turn forms an air-fuel mixture within the intake manifold 40. This formed air-fuel mixture is subsequently supplied into a combustion chamber of each cylinder of an engine body 50 and is burned under ignition of each of ignition plugs 51 through 54. The burned air-fuel mixture is discharged as an exhaust gas into an exhaust pipe 80 through an exhaust manifold 60 and a catalytic converter 70. The internal combustion engine E repeats the aforementioned operation.

In addition, the above-mentioned ignition plugs 51 through 54 are ignited by receiving a high electric voltage distributed by a distributor 90 in cooperation with an ignition circuit 100. The catalytic converter 70 acts a role for reducing harmful components (such as CO, HC, NOx and the like) of the exhaust gas from the exhaust manifold 60.

Furthermore, the fuel injection control system is provided with a rotation number sensor 110, a throttle sensor 120, a negative pressure sensor 130, a water temperature sensor 140, an intake air temperature sensor 150, an air-fuel ratio sensor and an oxygen concentration sensor 170. Hereinafter, function of these sensors will be explained simply.

The rotation number sensor 110 is mounted on the distributor 90 and detects the actual rotation number of an output shaft of the engine body 50 (corresponding to the actual rotation number of the internal combustion engine E) to generate a pulse signal in sequence at a frequency proportional to the detected result. The number of generation of the pulse signal from the rotation number sensor 110 is 24 pieces every two rotations (namely a 720 degree crank angle ) of the internal combustion engine E.

The throttle sensor 120 detects the actual opening degree of the throttle valve **20*a* to generate an opening degree detection signal indicative of the detected opening degree. The throttle sensor 120 also includes an idle switch therein. The idle switch detects the actual state of the throttle valve 20*a* when the throttle valve 20*a*** is fully closed and generates a full-close detection signal indicative of the detected result.

The negative pressure sensor 130 detects the actual negative pressure appearing at the downstream of the throttle valve **20*a* within the intake pipe 20 and generates a negative pressure detection signal indicative of the detected result. The water temperature sensor 140 detects the actual temperature of cooling water in a cooling system of the engine body 50** to produce a water temperature detection signal indicative of the detected water temperature.

The intake air temperature sensor 150 detects the actual temperature of the air stream flowing into the upstream of the throttle valve **20*a* within the intake pipe 20 and produces an intake air temperature detection signal indicative of the detected air temperature. The air-fuel ratio sensor 160 detects the actual unburnt oxygen concentration of the exhaust gas at the upstream of the catalytic converter 70 in the exhaust pipe 80 and produces an air-fuel ratio detection signal indicative of the detected result. In this case, the same air-fuel ratio detection signal takes a linear value to the actual air-fuel ratio λ of the air-fuel mixture supplied into the engine body 50**.

The oxygen concentration sensor 170 detects the actual unburnt oxygen concentration of the exhaust gas at the downstream of the catalytic converter 70 in the exhaust pipe 80 and produces an oxygen concentration detection signal indicative of the detected result. The oxygen concentration detection signal from the oxygen concentration sensor 170 indicates whether the air-fuel ratio λ is rich or lean with respect to the stoichiometric or theoretical air-fuel ratio λ 0. Because the sensors explained above are conventional ones, the detail explanation of their construction or the like is eliminated.

A microcomputer 180 is constructed by a CPU 181, ROM 182, RAM 183, a back-up RAM 184, an input port 185, an output port 186, a bus line 187 and the like.

The CPU 181 receives the pulse signal from the rotation number sensor 110, the opening degree detection signal and full-close detection signal from the throttle sensor 120, the negative pressure detection signal from the negative pressure sensor 130, the water temperature detection signal from the water temperature sensor 140, the intake air temperature detection signal from the intake air temperature sensor 150, the air-fuel ratio detection signal from the air-fuel ratio sensor 160 and the oxygen concentration detection signal from the oxygen concentration sensor 170 through the input port 185 and bus line 187. The CPU 181 also receives data stored in the ROM 182, the RAM 183 and the back-up RAM 184 respectively through the bus line 187. Thus, the CPU 181 executes a predetermined computer program for the fuel injection control system. During the execution, operation processing necessary for driving and controlling the fuel injection valves 41 through 44 and the ignition circuit 100 is performed by way of the bus line 187 and the output port 186.

The above-mentioned computer program is stored in the ROM 182. Furthermore, in the ROM 182 an optimal feedback gain for earliest converging state feedback, which is described below, and a lower feedback gain for slowing down a converging speed of the state feedback are set and stored respectively in correspondence to whether or not the detected value of the air-fuel ratio outputted from the aforementioned air-fuel ratio sensor 160 exists in a predetermined range wherein a control model described below may be maintained.

Next, techniques which are previously designed for performing control of the air-fuel ratio in the above-mentioned fuel injection control system will be explained in sequence.

(1) Modeling of Controlled Object

In this embodiment, an auto-regressive moving-average model of which model order is 1 and has a dead-time P=3 is used for the model of the system for controlling the air-fuel ratio λ of the internal combustion engine E, and the approximation is further made taking into account a disturbance d.

Firstly, the model of the system which uses the auto-regressive moving-average model to control the air-fuel ratio λ may be approximated as the following equation (1).

$$\lambda(K)=a.\lambda(K-1)+b.FAF(K-3) \quad \ldots (1)$$

where the reference character FAF indicates an air-fuel ratio correction coefficient in the equation (1). The reference characters a and b indicate constants, respectively. Furthermore, the reference character K indicates a variable representing the number of times of control after the initial sampling starting.

Taking into account the disturbance d, further, the model of the control system may be approximated by the following equation (2).

$$\lambda(K)=a \cdot \lambda(K-1)+b \cdot FAF(K-3)+d(K-1) \quad \ldots (2)$$

With respect to the model as previously approximated, it is easy to perform the discretization with the rotational period (360 degree crank angle) sampling by using the step response to determine the aforementioned constants a and b, respectively, that is, to obtain a transfer function G of the system for controlling the air-fuel ratio λ.

(2) Method for Indicating State Variable Quantity IX (IX indicates a vector quantity)

If rewriting the aforementioned equation (2) by using the state variable quantity IX(K) indicated by the following equation (3), the equation (2) becomes a matrix such as represented by an equation (4) and further becomes as equation (5). In the equation (3) the reference character T indicates a transpose of matrix.

$$IX(K)=[X1(K), X2(K), X3(K), X4(K)]^T \quad \ldots (3)$$

$$\begin{bmatrix} X1(K+1) \\ X2(K+1) \\ X3(K+1) \\ X4(K+1) \end{bmatrix} = \begin{bmatrix} a & b & 0 & 0 \\ 0 & 0 & 1 & 0 \\ 0 & 0 & 0 & 1 \\ 0 & 0 & 0 & 0 \end{bmatrix} \begin{bmatrix} X1(K) \\ X2(K) \\ X3(K) \\ X4(K) \end{bmatrix} + \begin{bmatrix} 0 \\ 0 \\ 0 \\ 1 \end{bmatrix} FAF(K) + \begin{bmatrix} 1 \\ 0 \\ 0 \\ 0 \end{bmatrix} d(K) \quad (4)$$

$$X1(K+1)=aX1(K)+bX2(K)+d(K)=\lambda(K+1)\ X2(K+1)=FAF(K-2)\ X3(K+1)=FAF(K-1)\ X4(K+1)=FAF(K) \quad \ldots (5)$$

(3) Design of Regulator

In the case of designing the regulator in terms of the above-mentioned equations (3) to (5), the air-fuel ratio correction coefficient FAF may be represented as the following equation (8) by using the following equation (6) regarding the optimal feedback gain IK (where IK has a vector quantity) and the following equation (7) regarding the state variable IX(K).

$$IK=[K1, K2, K3, K4] \quad \ldots (6)$$

$$IXT(K)=[\lambda L(K), FAF(K-3), FAF(K-2), FAF(K-1)] \quad \ldots (7)$$

$$\begin{aligned} FAF(K) &= IK \cdot IX^T(K) \\ &= K1 \cdot \lambda(K) + K2 \cdot FAF(K-3) + K3 \cdot FAF(K-2) + K4 \cdot FAF(K-1) \end{aligned} \quad (8)$$

Furthermore, when an integral term Zi(K) for absorbing the error is added in the equation (8), the air-fuel ratio correction coefficient FAF is given by the following equation (9).

$$FAF(K)=K1.\lambda(K)+K2.FAF(K-3)+K3.FAF(K-2)+K4.FAF(K-1)+ZI(K) \quad \ldots (9)$$

In addition, the aforementioned integral term ZI(K) is a value which is determined by a deviation between a target air-fuel ratio λTG and the actual air-fuel ratio λ(K) and an integral constant Ka, being given by the following equation (10).

$$ZI(K)=ZI(K-1)+Ka.(\lambda TG-\lambda(K)) \quad \ldots (10)$$

Figure 2:
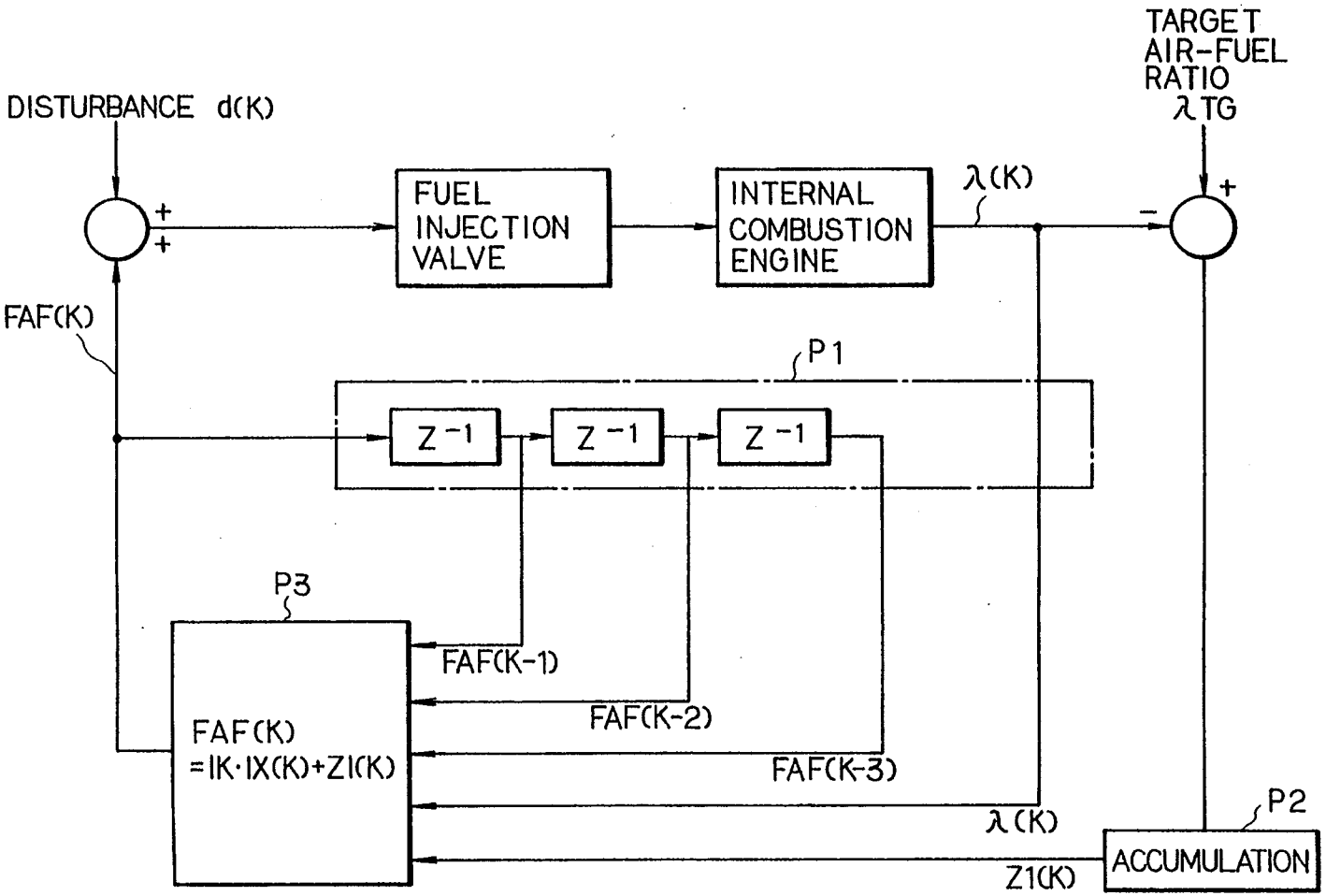
FIG. 2 is a block diagram illustrating construction of a state feedback system which is modelled in the air-fuel ratio control apparatus of the embodiment as its controlled object.

FIG. 2 is a block diagram of the aforementioned model-designed system for controlling the air-fuel ratio. Additionally, in FIG. 2 the indication is made using the (1/Z) transformation in order to derive the air-fuel ratio correction coefficient FAF(K) from FAF(K-1). However, in fact the past air-fuel ratio correction coefficient FAF(K-1) is stored in the RAM183 in advance and read out at the next control timing to be used. Incidentally "FAF(K-1)" indicates the air-fuel ratio correction coefficient one time before, "FAF(K-2)" indicates the air-fuel ratio correction coefficient two times before and "FAF(K-3)" indicates the air-fuel ratio correction coefficient three times before.

Furthermore, in FIG. 2, a block P1 surrounded by a dashed line designates a section for determining the state variable quantity IK(K) in the state that the air-fuel ratio λ is feedback-controlled toward the target air-fuel ratio λTG. A block P2 denotes a section (an accumulating section) for obtaining the integral term Z1(K), and a block P3 depicts a section for calculating the present air-fuel ratio correction coefficient FAF(K) on a basis of the state variable quantity IX(K) determined in the block P1 and the integral term Zi(K) obtained in the block P2.

(4) Determination of Optimal Feedback Gain IK and Integral constant Ka

The optimal feedback gain IK and the integral constant Ka may be set, for instance, by minimizing a performance function J as indicated by the following equation (11).

$$J=\Sigma[Q\{\lambda(K)-\lambda TG\}^2\ (K=0 \text{ to } \infty) +R\{FAF(K)-FAF(K-1)\}^2] \quad \ldots (11)$$

Here in the equation (11) the performance function J is intended to minimize the deviation between the air-fuel ratio λ(K) and the target air-fuel ratio λTG as it restricts the variation of the air-fuel ratio correction coefficient FAF(K). Weighting of the restriction with respect to the air-fuel ratio correction coefficient FAF(K) may be changed in accordance with values of the weighting parameters Q and R. Accordingly, simulation may be repetitively performed by changing the values of the weighting parameters Q and R until the optimal control characteristic may be obtained to thereby determine the optimal feedback gain IK and the integral constant Ka.

Furthermore, the optimal feedback gain IK and the integral constant Ka depend upon the previous model constants a and b (refer to the previous equation (2) or (4)). For ensuring the system stability (robustness) against the variation (a parameter variation) of the system for controlling the actual air-fuel ratio λ, it is therefore necessary to set the optimal feedback gain IK and the integral constant Ka by estimating the variations of the model constants a and b.

Accordingly, the simulation is effected by incorporating the actually possible variations of the model constants a and b to thereby determine the optimal feedback gain IK and integral constant Ka which may satisfy the stability.

Although the description has been made hereinabove in terms of modeling of the controlled object, indication method of the state variable quantity, design of the regulator and determination of the optimal feedback gain and the integral constant, it is assumed that these have been already set in the apparatus of the embodiment. Further, it is assumed that hereinafter control of the air-fuel ratio in the fuel injection control system is performed by using only the aforementioned equations (9) and (10).

Figure 3:
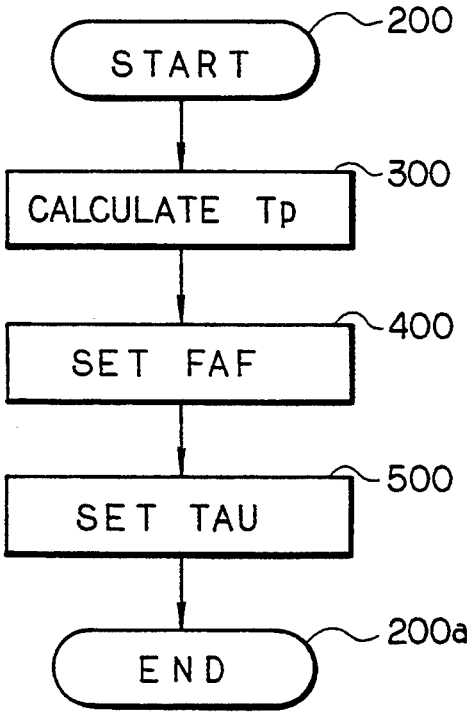
FIG. 3 is a flow chart showing a main processing routine for fuel injection quantity setting of the air-fuel ratio control apparatus of the same embodiment.
Figure 4:
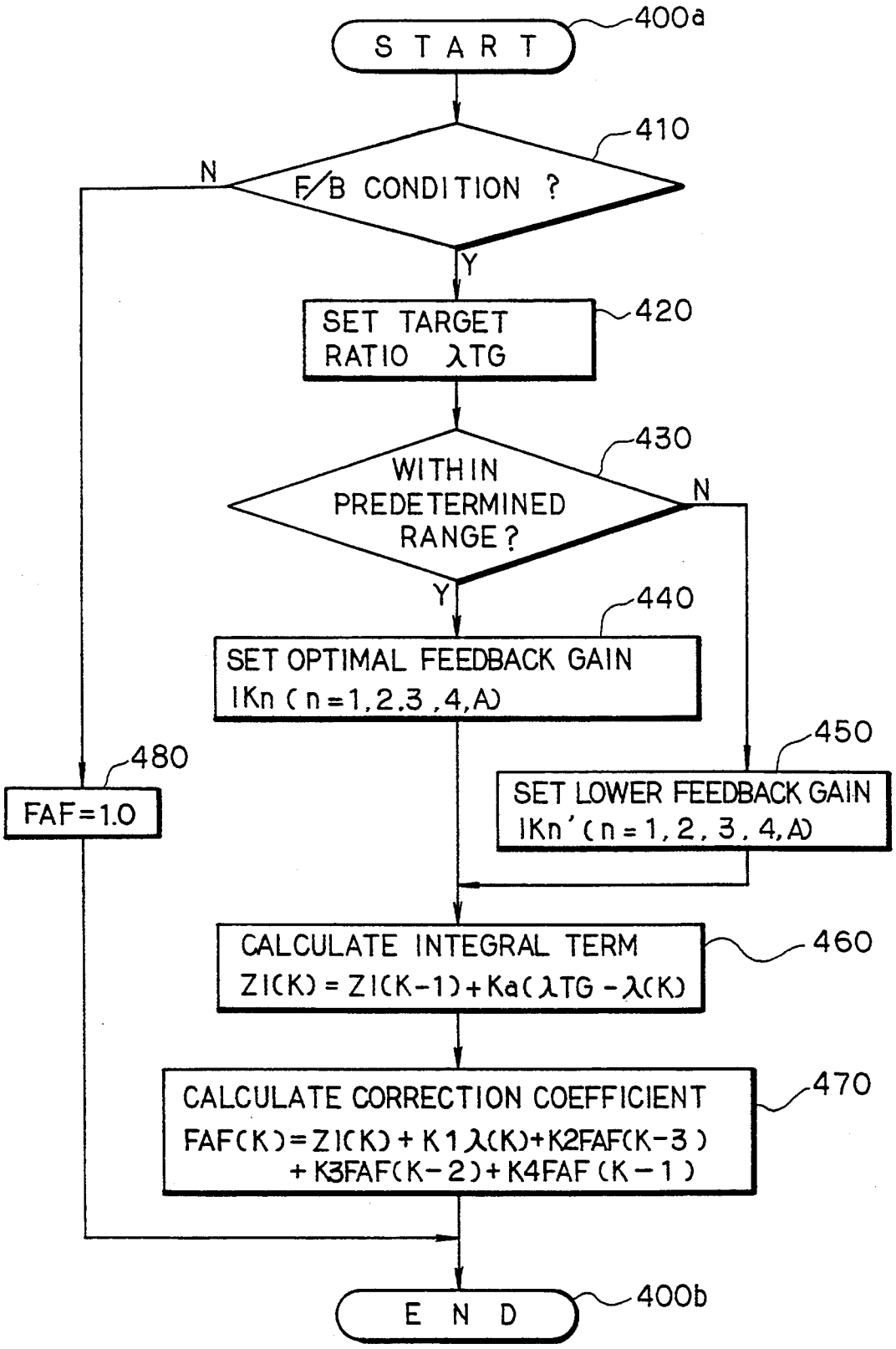
FIG. 4 is a flow chart illustrating detailed processing regarding setting procedure of an air-fuel ratio correction coefficient of a method shown in FIG. 3.
Figure 5:
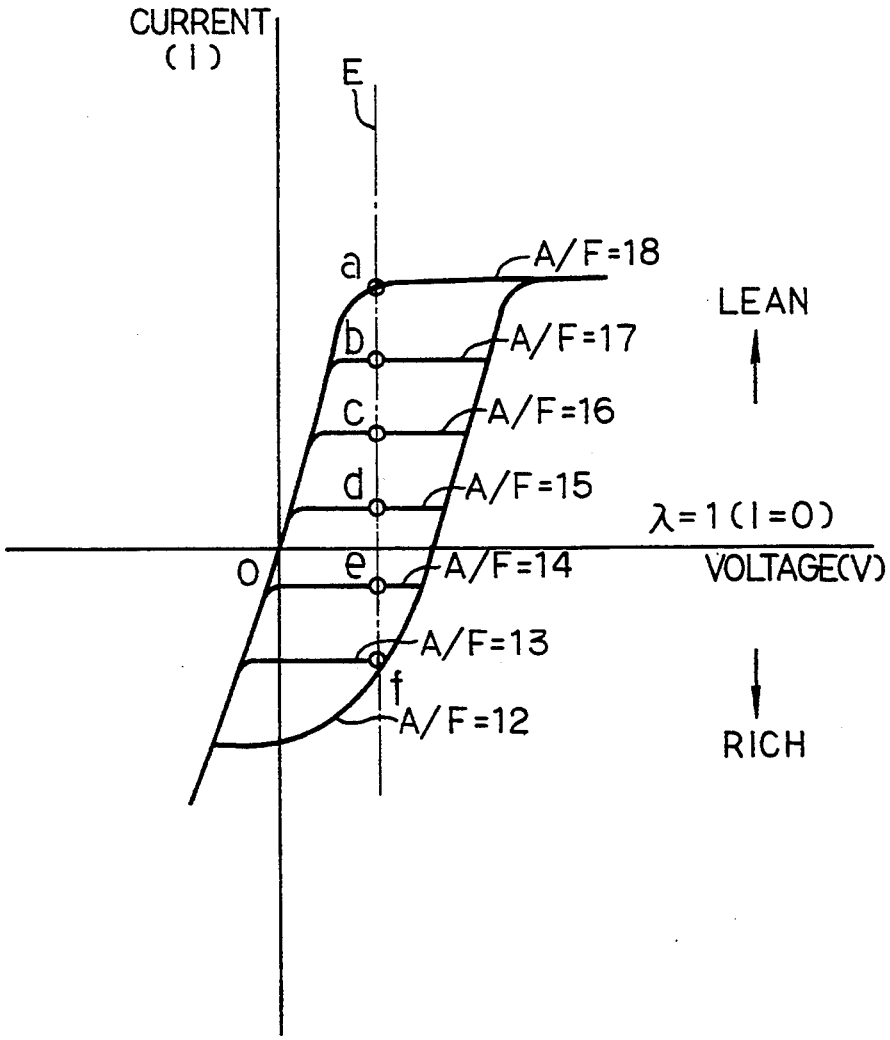
FIG. 5 is a graph depicting electric voltage-electric current characteristics of an air-fuel ratio sensor via each air-fuel ratio used in the air-fuel ratio control apparatus of the same embodiment.

In the apparatus of the embodiment as constructed above, when the fuel injection control system is conditioned in its operative state, the microcomputer 180 (exactly the CPU 181) starts execution of the computer program in accordance with the flow chart of FIG. 3 to FIG. 5.

Namely, the CPU 181 starts execution of the same program at a step 200 and thereafter calculates at a step 300 a basic injection quantity Tp of fuel to be injected into the intake manifold 40. Calculation of the basic injection quantity Tp is performed on a basis of a frequency (in accordance with which a rotation number Ne of the internal combustion engine E is naturally obtained) of a pulse signal outputted from the rotation number sensor 110 at every 360 degrees crank angle of the internal combustion engine E, a value (hereinafter called as a negative pressure PM) of a negative pressure detection signal outputted from the negative pressure sensor 130 and the like. The CPU 181 which has thus calculated the basic injection quantity Tp of fuel, in turn, advances the computer program to an air-fuel ratio operation processing routine 400 (refer to FIG. 4) wherein calculation and setting of the previously described air-fuel ratio correction coefficient FAF are started.

Hereinafter, processing method of the CPU 181 in the air-fuel ratio operation processing routine 400 will be explained with reference to FIG. 4.

The CPU 181 which has started at a step 400*a* execution of the air-fuel ratio operation processing routine 400 determines at the following step 410 as to whether the feedback condition of the air-fuel ratio λ is satisfied or not. Satisfaction of the feedback condition may be given by the facts that cooling water temperature of the cooling system of the engine body 50 is equal to or higher than a predetermined water temperature and that a rotation number and load of the internal combustion engine E is not high, and the like.

When the feedback condition is not satisfied at this stage, the CPU 181 determines "NO" at the step 410 and sets the air-fuel ratio correction coefficient FAF into "FAF=1.0". That is, this means that the air-fuel ratio λ is not corrected, resulting in so-called open loop control in this case.

When the operation processing of the air-fuel ratio operation processing routine 400 thus ends at a step 400b, the CPU 181 calculates and sets at a step 500 (refer to FIG. 3) a fuel injection quantity TAU to be controlled at this stage, on a basis of the following equation (12).

$$TAU = FAF.Tp.FALL \quad \ldots (12)$$

Incidentally, in the equation (12) FAF indicates the air-fuel correction coefficient obtained in the air-fuel ratio operation processing routine 400, Tp represents the basic injection quantity of fuel obtained at the aforementioned step 300, and FALL indicates a correction coefficient with which the fuel injection control system corrects the fuel injection quantity by various factors other than the air-fuel control executed here. As correction based on the correction coefficient FALL, there are, for instance, correction by an exhaust gas recirculation system or EGR, correction by an electric voltage at its point of time, correction by a water temperature at its point of time and so on.

Meanwhile, if the feedback condition of the air-fuel ratio λ is satisfied, the computer program proceeds to the step 410 as previously described, the CPU 181 determines "YES" at the same step 410.

The CPU 181 which has thus determined that the feedback condition is satisfied sets at a step 420 a target air-fuel ratio λTG according to an operating state of the internal combustion engine E at its point of time. Thereafter, the CPU 181 determines at a step 430 whether or not a detected value of the air-fuel ratio sensor 160 exists in a predetermined range in which the aforementioned set control model may be maintained.

Here, an example of a method for determining the detected value will be explained with reference to FIG. 5.

FIG. 5 is a graph depicting an electric voltage (V)—electric current (I) characteristic of the air-fuel ratio sensor 160 against each air-fuel ratio. Curved lines shown by solid lines become electric voltage (V)—electric current (I) characteristic lines of the air-fuel ratio sensor 160 corresponding respectively to the air-fuel ratio A/F=12, the air-fuel ratio A/F=13, the air-fuel ratio A/F=14, the air-fuel ratio A/F=15, the air-fuel ratio A/F=16, the air-fuel ratio A/F=17 and the air-fuel ratio A/F=18. Furthermore, in FIG. 5 a linear line E shown by a dashed line indicates a value of an electric voltage applied between electrodes (not shown) of the above-mentioned air-fuel ratio sensor 160 and also indicates that a linear detection of the air-fuel ratio A/F is possible respectively at points a, b, c, d, e and f where the linear line E intersects the aforementioned curved lines. Thus, in the apparatus of the embodiment the following range is determined as a predetermined range in which the aforementioned set control model may be maintained and the linear detection is possible.

$$13 \leqq A/F \leqq 18 \text{ (in case of FIG. 5)}$$

Accordingly, the CPU 181 determines "YES" if the detected value of the air-fuel ratio A/F outputted from the aforementioned air-fuel ratio sensor 160 exists in the range of "13≦A/F≦18" and determines "NO" in case the detected value of the air-fuel ratio A/F deviates from the same range of "13≦A/F ≦18".

Now in case of deciding "YES" in such determination at the step 430, that is, in case the decision is made that the detected value of the air-fuel ratio sensor 160 exists in the aforementioned range, the CPU 181 executes a step 440 for selectively reading thereinto optimal feedback gains IKn (n=1, 2, 3, 4, A) of the state feedback system which are set and stored in the ROM 182. On the other hand, in case of deciding "NO" in such determination at the step 430, that is, in case the decision is made that the detected value of the.air-fuel sensor 160 is out of the aforementioned range, the CPU 181 executes a step 450 for selectively reading thereinto lower feedback gains IKn′ (n=1, 2, 3, 4, A) of the feedback gains which are set and stored in the same ROM 182. These feedback gains IKn (n=1, 2, 3, 4, A) or IKn′ (n=1, 2, 3, 4, A) are values for defining the feedback constants "K1" to "K4" in the previous equation (9) and the feedback constant "Ka" in the previous equation (10) respectively.

At the following step 460 the CPU 181 then substitutes the selectively read feedback gain IKn (n=A) or IKn'(n=A) for the previous equation (10) to calculate the integral term ZI(K) and further substitutes the selectively read feedback gain IKn (n=1, 2, 3, 4) or IK'(n=1, 2, 3, 4) for the previous equation (9) at a step 470 to calculate the air-fuel ratio correction coefficient FAF.

When thus ended calculation of the air-fuel ratio correction coefficient FAF at the step 470, the CPU 181 calculates and sets at a step 500 (refer to FIG. 3) the fuel injection quantity TAU to be controlled at that time, on a basis of the equation (12) like the previous processing.

Thereafter, the CPU 181 applies the set fuel injection quantity TAU as a fuel injection output signal to the fuel injection valves 41 to 44 through the bus line 187 and output port 186. Accordingly, the fuel injection valves 41 to 44 inject fuel supplied under pressure from the fuel tank into the intake manifold 40 with the quantity corresponding to a value of the fuel injection output signal.

As described above, for performing air-fuel ratio control based on the modern control theory, the apparatus of the embodiment is provided in advance with both of air-fuel ratio correction coefficient operation processing means which includes: an operation processing part for obtaining the air-fuel ratio correction coefficient FAF with the optimal feedback gain which is previously set in order to converge the state feedback at a high speed; and an operation processing part for obtaining the same air-fuel ratio correction coefficient FAF With the low feedback gain which is previously set in order to converging the same state feedback slowly.

Thus, the state feedback is converged with the aforementioned optimal feedback gain at the high speed in case the determination is made that the detected value of the air-fuel ratio sensor exists in the predetermined range wherein the above-mentioned set control model may be maintained, whereas the same state feedback is converged with the lower feedback gain slowly in case the same detected value is out of the aforementioned predetermined range. Accordingly, overcorrection or correction shortage caused by the aforementioned state feedback is restrained naturally, in case the detected value of the air-fuel ratio sensor is especially out of the predetermined range wherein the aforementioned set control model may be maintained. Even in case maintenance of the same control model is not desirable, therefore, generation of hunting or the like caused by it may be well prevented. Moreover, such feedback given by slowing down the converging speed is performed only while the detected value of the air-fuel sensor is deviating from the predetermined range. Consequentially, this does not lead to lowering responsiveness as the whole control apparatus.

Figure 6:
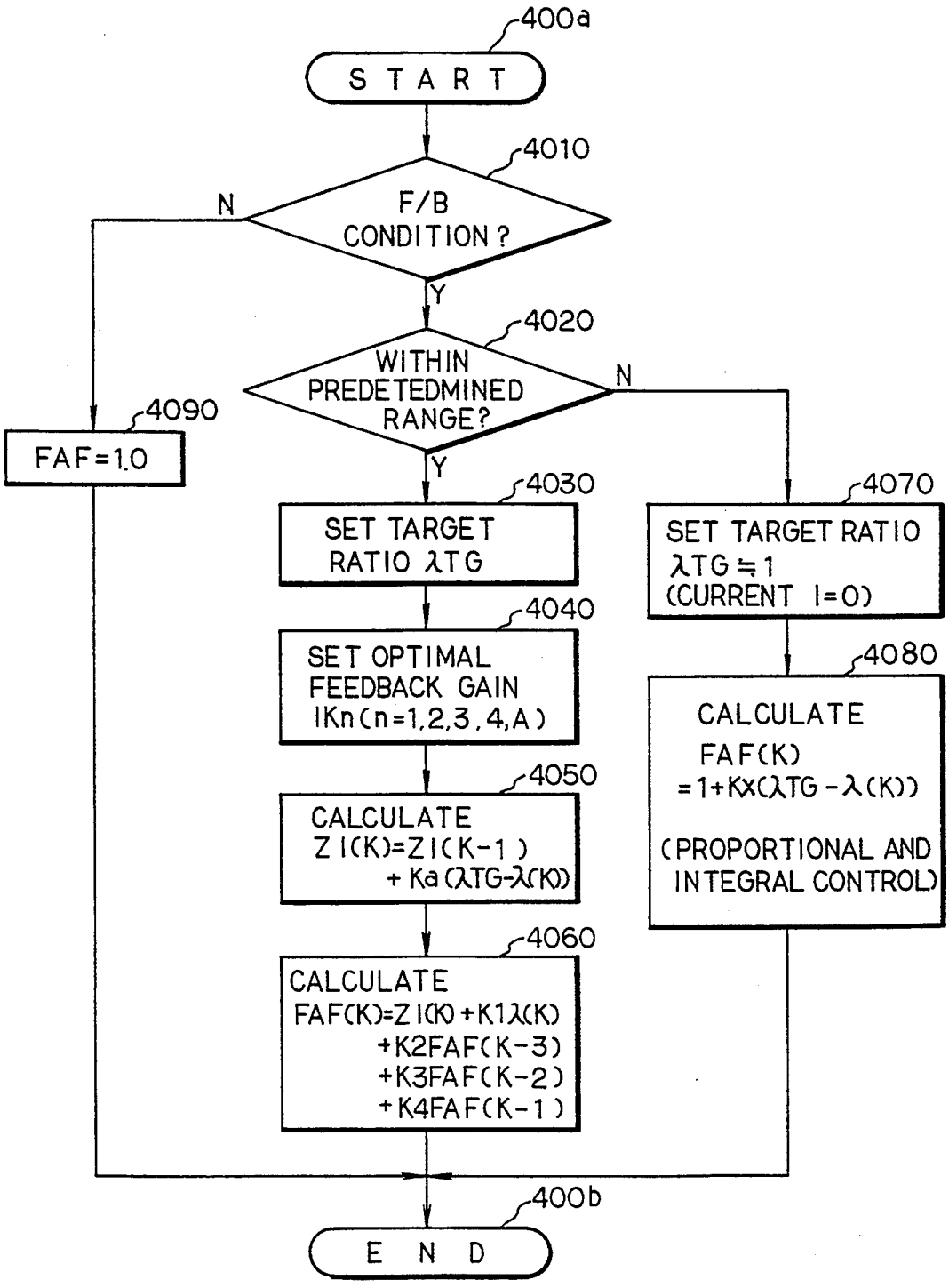
FIG. 6 is a flow chart showing another processing example regarding setting procedure of the aforementioned air-fuel ratio correction coefficient.
Figure 7:
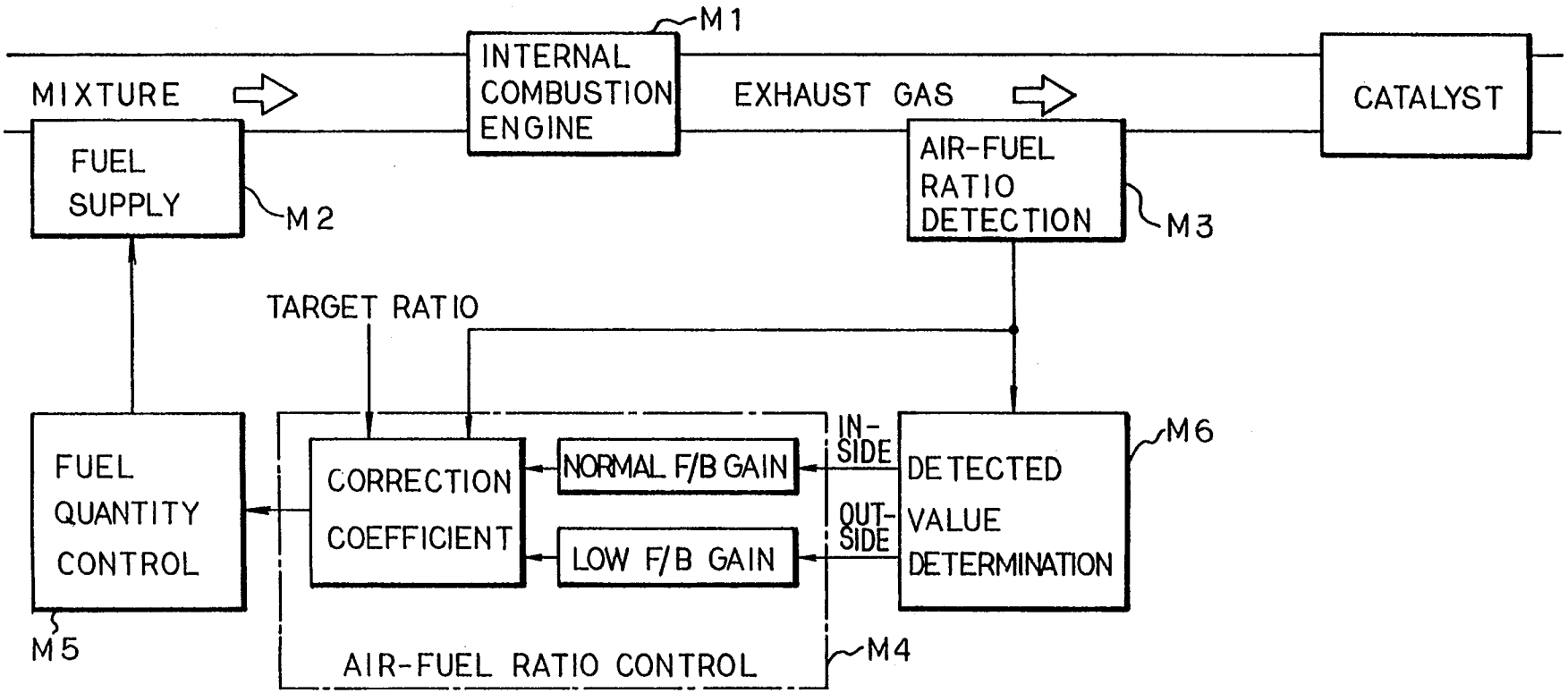
FIG. 7 is a block diagram illustrating a constructional concept of the air-fuel ratio control apparatus of the internal combustion engine in accordance with the first aspect of the invention.

As the other embodiment of the air-fuel ratio control apparatus in accordance with the invention, FIG. 6 illustrates an air-fuel ratio correction coefficient setting method of air-fuel ratio control means corresponding to an essential portion of the other embodiment. Namely, in this embodiment the basic construction and modelling method are also like those described previously. Only the setting method of the air-fuel ratio correction coefficient FAF as the step 400 of FIG. 3 is different from the apparatus of the aforementioned embodiment shown in FIG. 1 to FIG. 4. Hereinafter, the duplicate explanation is thus eliminated, and only the portion which is different from the apparatus of the embodiment shown in FIG. 1 to FIG. 4 will be described.

The apparatus of the embodiment of which the essential portion is shown in FIG. 6 is provided as air-fuel ratio control means with both of the following air-fuel correction coefficient operation means: an operation part for obtaining the air-fuel ratio correction coefficient FAF corresponding to the target air-fuel ratio λTG set according to each occasional state of the internal combustion engine as it performs the state feedback for controlling the detected air-fuel ratio toward the target air-fuel ratio; and an operation part for obtaining the corresponding air-fuel ratio correction coefficient FAF with normal proportional/integral processing wherein the target air-fuel ratio λTG is determined as a particular value, for instance "1".

Thus, the state feedback based on the modern control theory is performed to converge the system at a high speed in case the determination is made that the detected value of the air-fuel ratio sensor exists in the predetermined range wherein the set control model may be maintained, whereas the normal proportional-/integral control which is known conventionally is performed, that is, no modern control using the dynamic model is performed, to slowly converge the feedback system in case the determintion is that the same detected value is out of the aforementioned range.

That is, the CPU 181 which has determined at a step 4010 of FIG. 6 that the feedback condition is satisfied performs at the following step 4020 the same decision as the aforementioned decision to the detected value of the air-fuel ratio sensor 160, namely the same decision as that at the step 430 of FIG. 4. In case the decision is there made that the detected value of the air-fuel ratio sensor 160 exists in the aforementioned range (namely "YES"), the CPU 181 performs calculation and setting of the air-fuel ratio correction coefficient FAF based on the modern control theory according to the following procedures. (1) The target air-fuel ratio λTG according to an operating state of the internal combustion engine E at its point of time is set at a step 4030 of FIG. 6, and the optimal feedback gains IKn (n=1, 2, 3, 4, A) which are set and stored into the ROM 182 are subsequently read into at a step 4050 of FIG. 6. (2) The read-into optimal feedback gain IKn (n=A) is substituted for the previous equation (10) to calculate the integral term ZI(K) at a step 4050 of FIG. 6, and the same read-into optimal feedback gain IKn (n=1, 2, 3, 4) is further substituted into the previous equation (9) to calculate the air-fuel ratio correction coefficient FAF at a step 4060 of FIG. 6.

When calculation of the air-fuel ratio correction coefficient FAF at the step 4060 has been thus ended, the CPU 181 calculates and sets at the step 500 (refer to FIG. 3) the fuel injection quantity TAU to be controlled at that time, on a basis of the equation (12) like the previous calculation at the step 500.

On the other hand, in case the decision is made at the aforementioned step 4020 that the detected value of the air-fuel ratio sensor 160 is out of the aforementioned predetermined range (namely "NO"), the CPU 181 sets the above-mentioned air-fuel ratio λTG into substantially "1" at a step 4070. Incidentally this means that a sensor electric current i of the air-fuel ratio sensor 160 is set into I=0. In this case, the CPU 181 calculates the air-fuel ratio correction coefficient FAF at a step 4080 on a basis of proportional/integral operation given by the following equation (13).

$$FAF(K)=1+Kx\ (\lambda TG-\lambda(K)) \quad \ldots (13)$$

Additionally, in the equation (13), Kx is an integral constant for correcting the deviation of the air-fuel ratio. In this instance, the detected value of the air-fuel ratio sensor 160 is maintained in unstable condition which deviates from the linear range. From this reason, the integral constant Kx is made comparatively small to set the air-fuel ratio correction coefficient FAF for avoiding sudden correction.

The processings at the step 500 (refer to FIG. 3) and thereafter after the air-fuel ratio correction coefficient FAF has been calculated and set in such a way are like the previous processings.

In the embodiment the air-fuel ratio correction coefficient FAF is also set into "FAF=1.0" at a step 4090, in case the decision is made at the aforementioned step 4010 that the feedback condition is not satisfied, and the computer program proceeds to an open loop control.

As described above, even in the apparatus of the embodiment of which the essential portion is shown in FIG. 6, the slowed-down feedback based on the proportional/integral control is performed in case the detected value of the air-fuel ratio sensor deviates from the predetermined range wherein the aforementioned set control model may be maintained. Accordingly, overcorrection or correction shortage is restrained like the previous description. In this case, therefore, generation of hunting or the like is also well prevented.

In addition in case of the apparatus of the embodiment shown in FIG. 6, the aforementioned optimal feedback gain IKn (n =1, 2, 3, 4, A) and the aforementioned integral constant Kx are stored in advance in the previous ROM 182.

While in any of the above-mentioned embodiments the internal combustion engine and its fuel injection control system have the construction shown in FIG. 1, the air-fuel ratio control apparatus of the internal combustion engine according to the first invention may be, of course, not limited to adaptation for the internal combustion engine and its fuel injection control system shown in FIG. 1. If modelling of the controlled object is possible with the mode shown previously in FIG. 2, the first invention may be also applied to any of the other internal combustion engine and its fuel injection control system like the previous description.

The method shown in FIG. 4 or FIG. 6 as processings for obtaining the air-fuel ratio correction coefficient is also only one example. In a word, the method has only to be one adequate for setting the air-fuel ratio correction coefficient with a mode wherein the system of feedback is converged slowly, when the decision is made that the detected value of the air-fuel ratio is out of the predetermined range.

As explained above, in accordance with the first invention the converging speed of the feedback system is slowed down under decision that the detected value of the air-fuel ratio is out of the predetermined range wherein the previously set control model may be maintained. Accordingly, overcorrection or correction shortage caused by the same feedback is also restrained naturally. Even maintenance of the aforementioned control model is not desirable, generation of the hunting or the like caused by it may be prevented well.

Furthermore, the feedback given by slowing down the converging speed in this way is performed only when the detected value of the air-fuel ratio deviates from the aforementioned predetermined range. Accordingly, this does not lead to lowering response speed as the whole control apparatus.

Next, a further preferred embodiment of the invention will be explained. Because descriptions in FIG. 1 to FIG. 3 regarding the embodiment of the invention are applied likewise to the corresponding descriptions of the further embodiment of the invention, the explanation thereof is eliminated for brevity.

In the embodiment of the invention, the CPU 181 determines "YES" at a step 410 (refer to FIG. 8), if the feedback condition of the air-fuel ratio λ is satisfied when the computer program proceeds to the same step 410.

The CPU 181 which has thus determined that the feedback condition is satisfied with sets at a step 420 the target air-fuel ratio λTG according to an operating state of the internal combustion engine E at its point of time, and thereafter determines at a step **430*a* whether or not the air-fuel ratio sensor 160 is stable and maintained in an air-fuel ratio detectable state. A routine for this determination will be described later in detail with reference to FIG. 9 in addition to FIG. 8**.

In case the decision is here made that the air-fuel ratio sensor 160 is in a stable state, the CPU 181 executes a step **440*a* for selectively reading thereinto a feedback gain (conventionally called as "a first control model") which is a control model modelled corresponding to the stable state of the air-fuel ratio sensor 160 among the optimal feedback gains IKn (n=1, 2, 3, 4, A) set and stored respectively in the ROM 182 and may most quickly converge the feedback system shown in FIG. 2 of the embodiment of the first invention. On the other hand, in case the decision is made that the same air-fuel ratio sensor 160 is in an unstable state, the CPU 181 executes a step 450*a* for selectively reading thereinto a feedback gain (conventionally called as "a second control model") which is a control model modelled corresponding to the unstable state of the air-fuel ratio sensor 160 among the optimal feedback gains IKn (n=1, 2, 3, 4, A) set and stored respectively in the ROM 182 and may most quickly converge the feedback system shown in FIG. 2**.

These optimal feedback gains IKn (n=1, 2, 3, 4, A) are values for specifying the feedback constants "K1" to "K4" of the previous equation (9) and the feedback constant "Ka" of the previous equation (10). Generally, if the control model is different according to the stable state/unstable state of the air-fuel ratio sensor-in such a way, the constants a and b of the previous equation (4) also become naturally different values, and besides values of the optimal feedback gains IKn (n =1, 2, 3, 4, A) also become different values according to the difference of these control models. Then, it is like the above description that the optimal feedback gains IKn (n=1, 2, 3, 4, A) different according to difference of these control models, that is, the first and second control models may be set experimentally on a basis of the previous equation (11).

Then, the CPU 181 substitutes the selectively read-into optimal feedback gain IKn (n=A) at the following step **460*a* for the previous equation (10) to calculate the integral term ZI(K), and further substitutes the selectively read-into optimal feedback gain IKn (n=1, 2, 3, 4) at a step 470*a*** for the previous equation (9) to calculate the air-fuel ratio correction coefficient FAF.

When calculation of the air-fuel ratio correction coefficient FAF at the step 470a is ended in such a way, the CPU 181 calculates and sets a fuel injection quantity TAU to be controlled at that time, on a basis of the equation (12) like the case in the step 500 (refer to FIG. 3).

Thereafter, the CPU 181 applies the set fuel injection quantity TAU as a fuel injection output signal to the fuel injection valves 41 to 44 through the bus line 187 and the output port 186. Accordingly, the fuel injection valves 41 to 44 inject fuel under pressure from the fuel tank into the intake manifold 40 with the quantity corresponding to a value of the fuel injection output signal.

Additionally, in case the determination is made in the determination at the aforementioned step 430a that the air-fuel ratio sensor 160 is inactive, the air-fuel ratio correction coefficient FAF is forcibly made "1.0" through the previous step 480. Namely, when the air-fuel ratio sensor 160 is inactive, the normal air-fuel ratio control is originally impossible even if the feedback condition is satisfied with. Accordingly, the air-fuel ratio control is conditioned in an open loop control and correction of the air-fuel ratio is not made.

Here, one example of a determination routine corresponding to the aforementioned step 430a will be explained in detail with respect to FIG. 9.

Namely, in this routine, after an element temperature TAF of the air-fuel ratio sensor 160 has been detected at a step 4311, the determination is made at a step 4312 as to whether or not the element temperature TAF is equal to or higher than 700° C. When the element temperature TAF is equal to or higher than 700° C., the computer program proceeds to a step 4314. At the step 4314, a counter CAF which is built in the microcomputer 180 itself is incremented by "1". At a step 4315 the determination is then made as to whether or not time wherein the element temperature TAF is equal to or higher than 700° C. has continued during more than time corresponding to for instance a count value "10" of the same counter CAF. If this condition is satisfied, the computer program proceeds to a step 4318 wherein the determination is made an "output stabilized" state. In case the determination is made at determination of the step 4315 that the aforementioned continuous condition of the element temperature TAF is not satisfied, the determination is made at a step 4317 an "output not stabilized" state.

On the other hand, in case the determination is made at the aforementioned step 4312 that the element temperature TAF is less than 700° C. the determination is further made at a step 4313 as to whether or not the element temperature TAF is equal to or higher than 550° C. When the element temperature TAF is equal to or higher than 550° C., the decision is made an "output not stabilized" state at the step 4317. When the element temperature TAF is less than 550° C., the decision is made an "inactive" state at a step 4316.

According to such a determination routine, it is possible to make very highly reliable determination regarding the stable/unstable state of the air-fuel ratio sensor 160, as compared with a method for determining the same stable/unstable state by solely detecting the temperature of the air-fuel ratio sensor 160.

Figure 10:
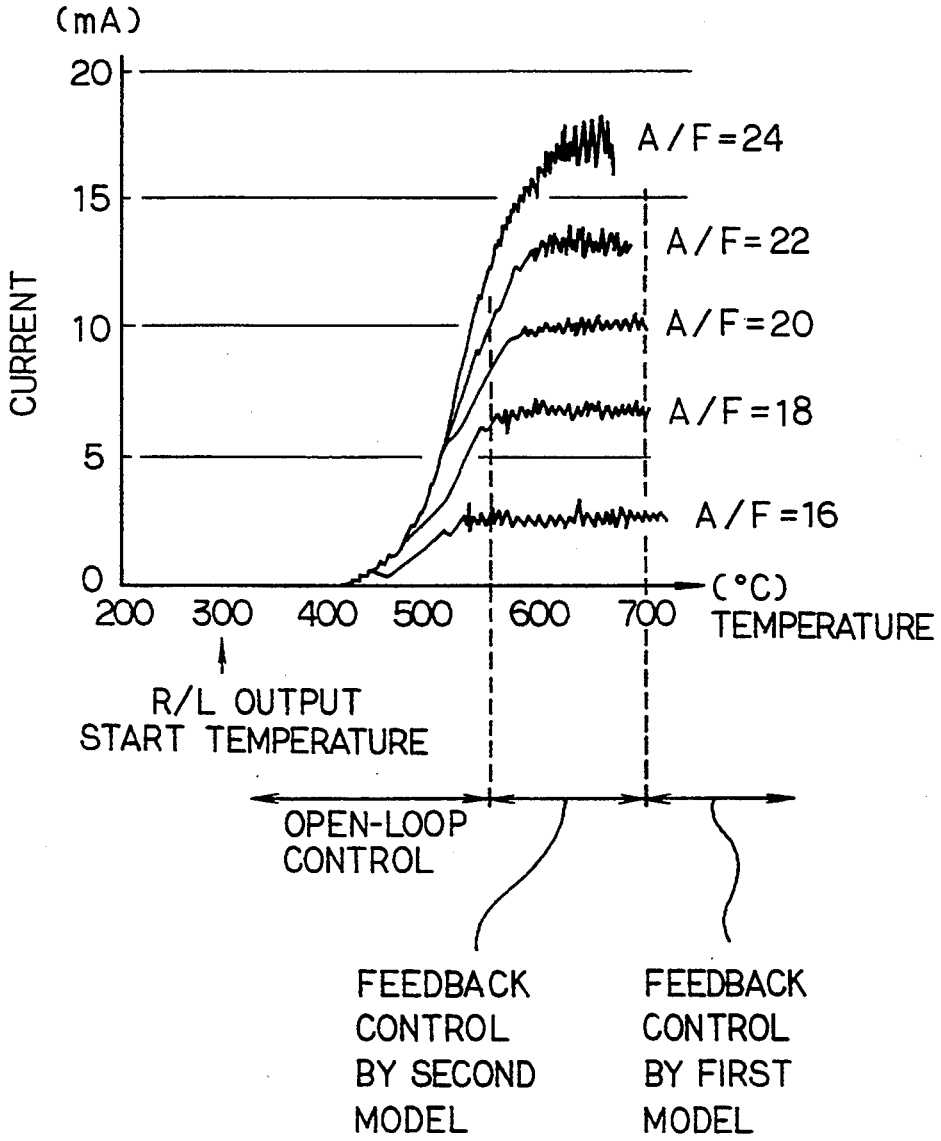
FIG. 10 is a graph depicting control mode transition given by the air-fuel ratio control apparatus of the aforementioned embodiment with a temperature-limiting electric current of an air-fuel ratio sensor applied to the air-fuel ratio control apparatus of the same embodiment.

FIG. 10 shows temperature-limiting electric current characteristics of such an air-fuel ratio sensor for reference. The feedback control given by the aforementioned first control model, the feedback control given by the aforementioned second control model and the open control which is not applicable thereto become respectively performed with modes appended in FIG. 10, by performing the air-fuel ratio control based on the aforementioned determination routine through the apparatus of the above-mentioned embodiment. In addition, for performing the feedback control given by the first control model, to be exact, "a time component" that the aforementioned element temperature TAF is maintained equal to or higher than 700° C. is also introduced. Illustration of "the time component" is however eliminated in FIG. 10 for the sake of convenience.

According to the embodiment as explained above, the feedback controls based on these first and second control models are selectively performed in accordance with the determination result of the stable state/unstable state of the air-fuel ratio sensor. That is, even if the air-fuel ratio sensor is maintained in any states except the case that the air-fuel ratio sensor is inactive there is realized the air-fuel ratio control, based on the modern control theory, which is rich in flexibility and excellent in response characteristics.

Figure 9:
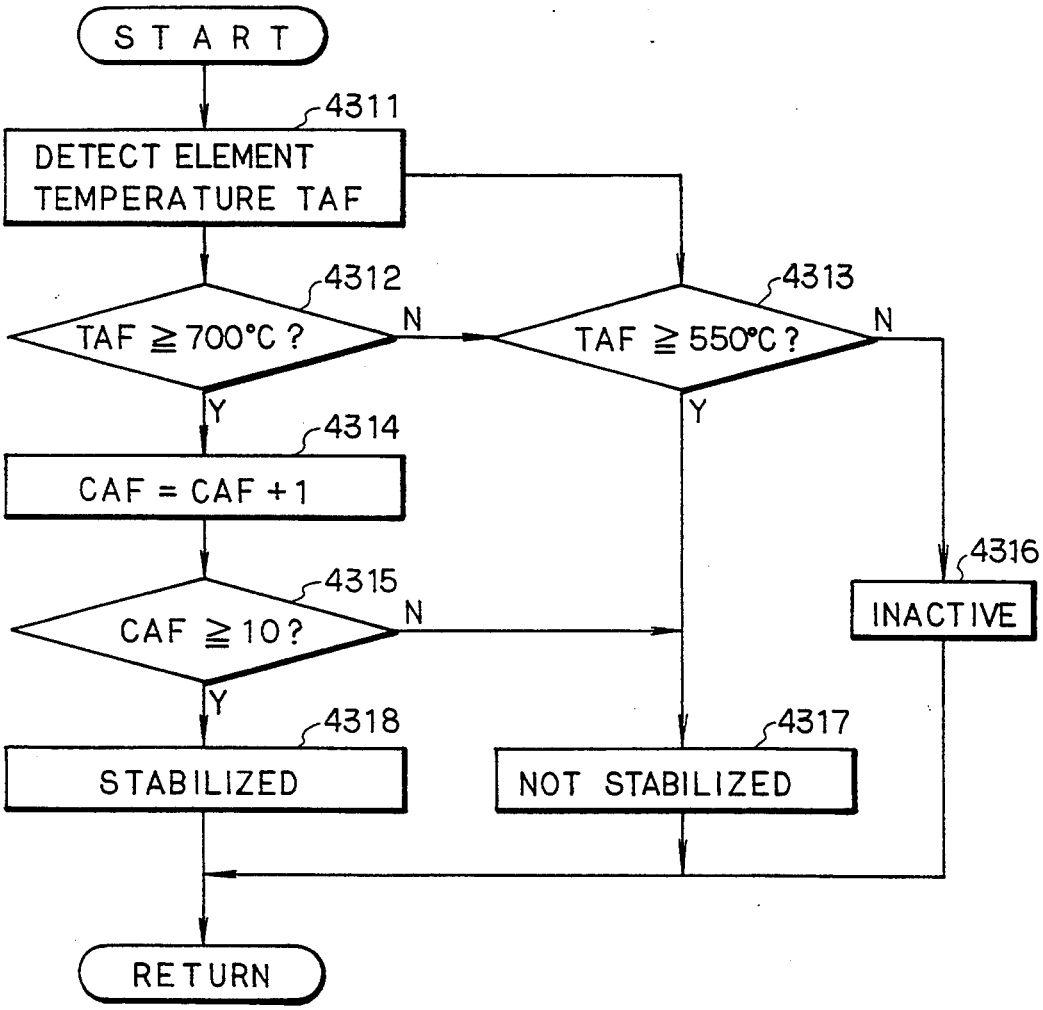
FIG. 9 is a flow chart illustrating a detailed processing regarding determination procedure of a stable/unstable state of an air-fuel sensor output shown in FIG. 8.

Here, the determination routine illustrated in FIG. 9 is used for determining the stable state/unstable state of the air-fuel ratio sensor in the above-mentioned embodiment. However, such a selection of the determination routine is optional. For instance a determination routine illustrated in FIG. 11 may be used.

Figure 12:
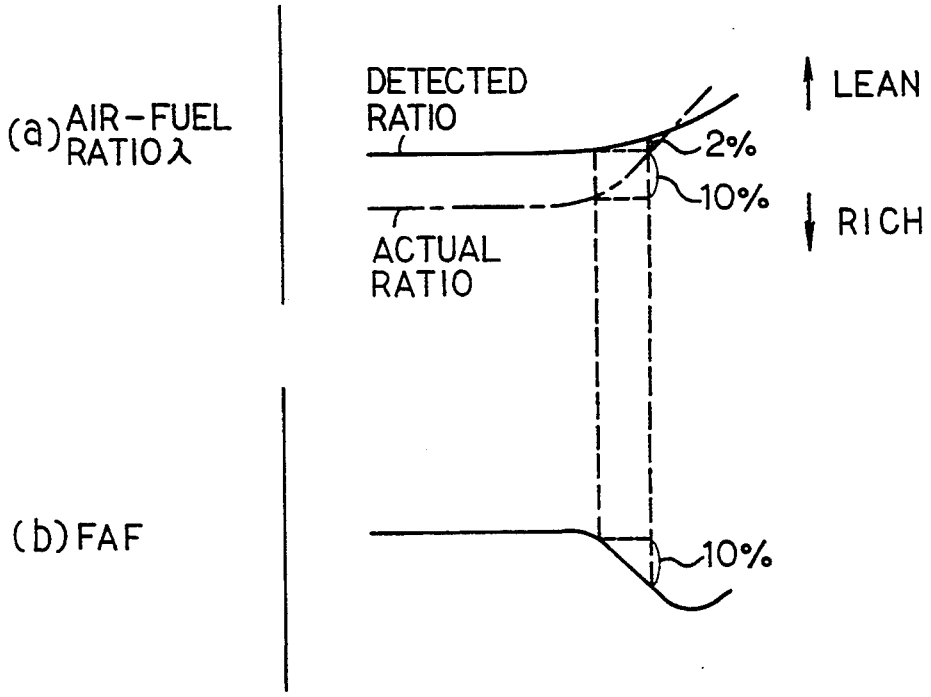
FIG. 12 is a timing chart illustrating dynamic relationship of the fuel injection quantity-air-fuel ratio in case the air-fuel ratio does not follow fluctuation of the fuel injection quantity.
Figure 13:
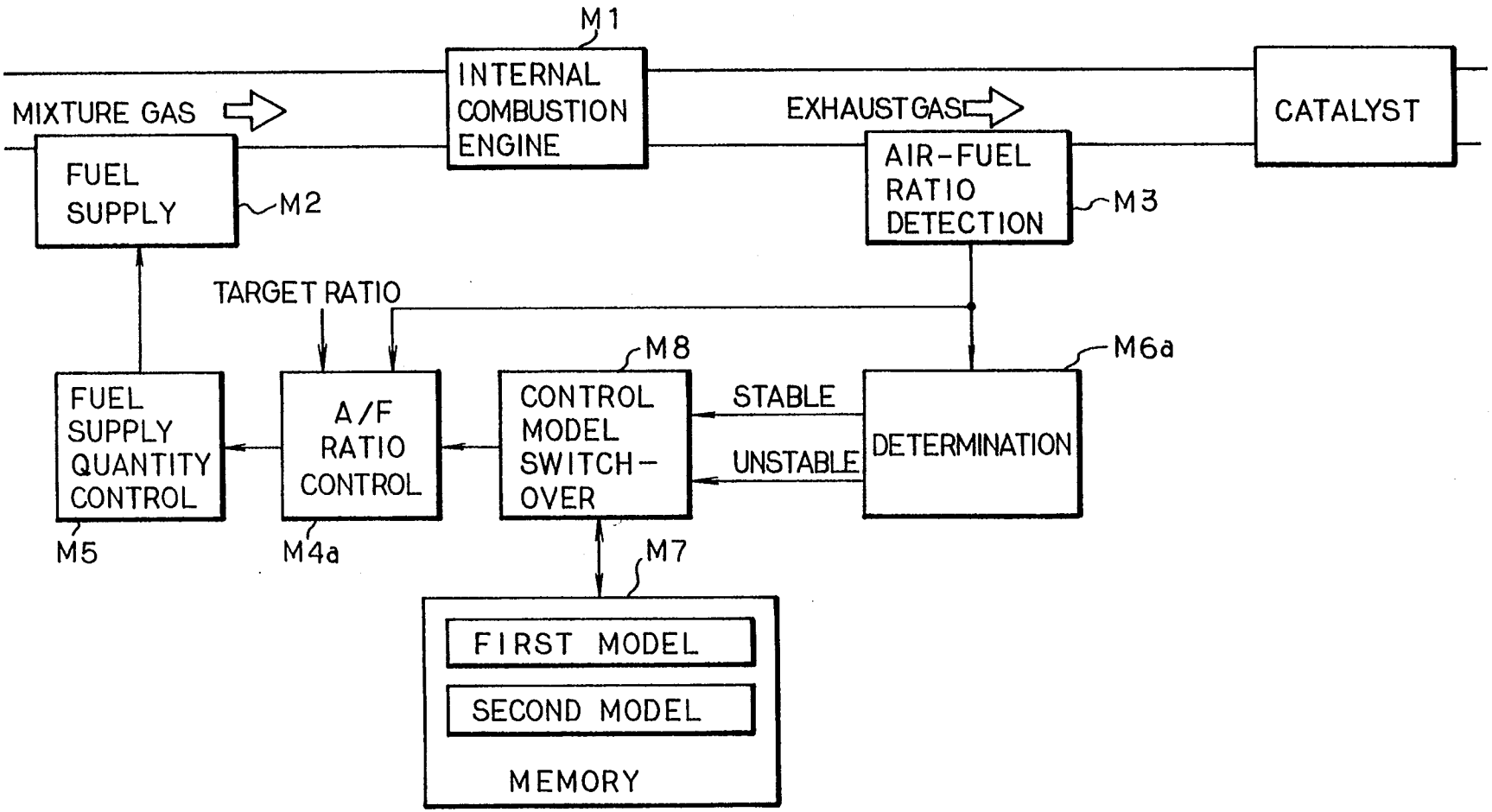
FIG. 13 is a block diagram showing a constructional concept of the air-fuel ratio control apparatus of the internal combustion engine in accordance with the second aspect of the invention.

In general, the air-fuel ratio does not follow fluctuation of the fuel injection quantity due to change of dynamic relationship of the fuel injection quantity- air-fuel ratio, when the output of the air-fuel ratio sensor is unstable. FIG. 12 illustrates such dynamic relationship of the fuel injection quantity-air-fuel ratio. That is, assuming that the fuel injection quantity follows fluctuation of the air-fuel ratio correction coefficient FAF shown in (b) of FIG. 12 to decrease by for instance 10%, the air-fuel ratio λ at that time should be also detected as a value indicating that the fuel has become lean by 10% in concentration, as shown by a dashed line of (a) of FIG. 12. When the output of the air-fuel ratio sensor itself is not stable in such a way, however, there is the possibility that the air-fuel ratio λ is detected as a value indicating that fuel has become lean by at most about 2%, as is shown for instance by a solid line of (a) of FIG. 12.

Figure 11:
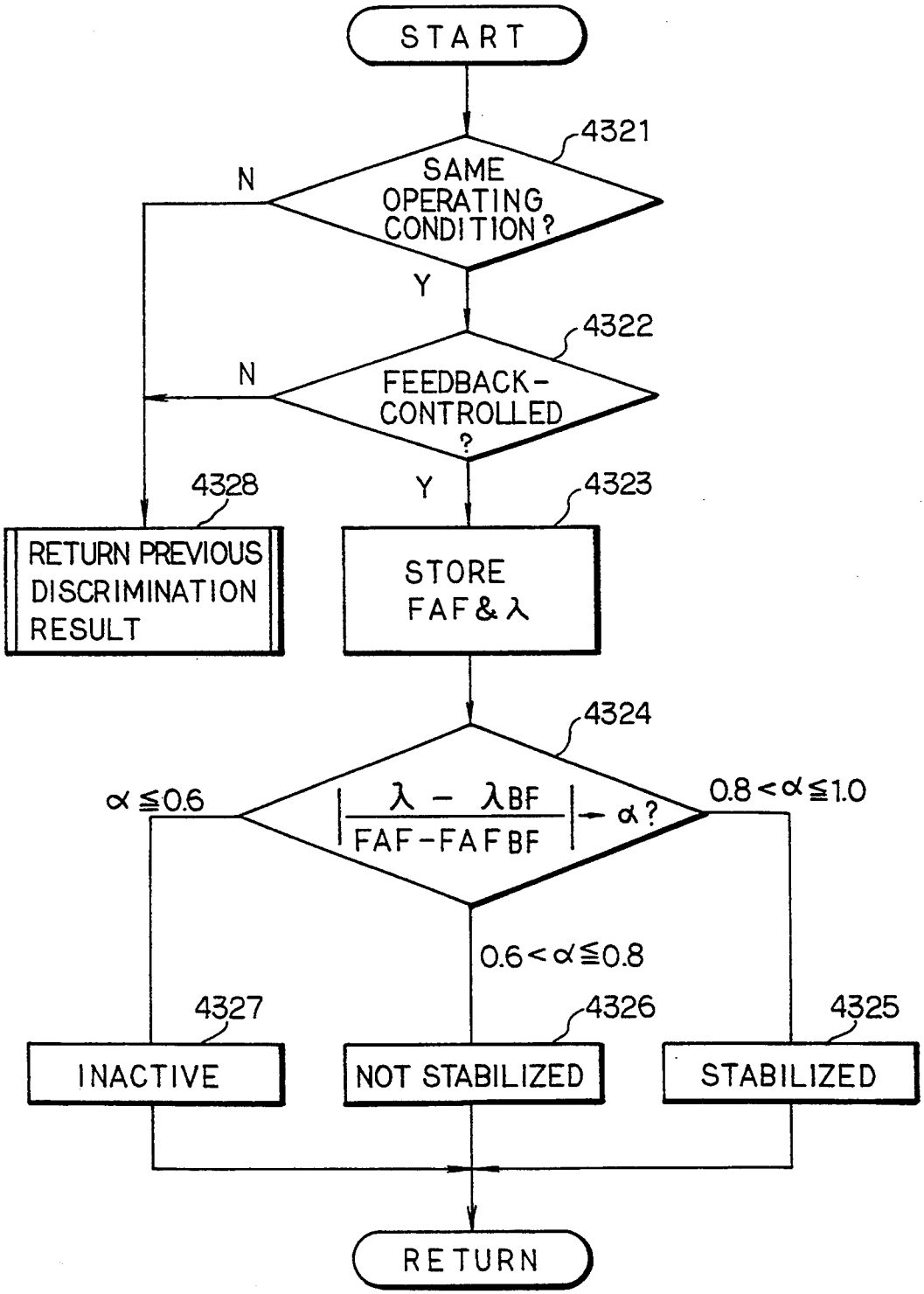
FIG. 11 is a flow chart showing another example of a processing method regarding the stable state/unstable state of the air-fuel ratio sensor output shown in FIG. 8.

In the determination routine illustrated in FIG. 11, therefore, the fact that the internal combustion engine E is maintained in the same operating condition is confirmed at a step 4321. After the fact that the the feedback is being performed at present has been confirmed at a step 4322, the air-fuel ratio correction coefficient FAF set at its point of time and the detected air-fuel ratio λ are stored into the RAM 183 at a step 4323. Thereafter, the dynamic relationship between the fuel injection quantity (here the fuel quantity correction coefficient FAF is made the fuel injection quantity) and the air-fuel ratio λ is confirmed at a step 4324. In addition, in the determination equation of the step 4324 it is assumed respectively that "λ" indicates the air-fuel ratio detected at its point of time, that "λBF" indicates the air-fuel ratio detected one time before, that "FAF" indicates the air-fuel ratio correction coefficient set at its point of time, and also that "FAFBF" indicates the air-fuel ratio correction coefficient set one time before. Accordingly, a value of "α" corresponding to an absolute value of the ratio between (λ−λBF) and (FAF−FAFBF) approaches "1.0" as the aforementioned dynamic relationship is held exactly, and conversely becomes small (namely approaches "0.1") as the aforementioned dynamic relationship changes. Thus, the value of the aforementioned "$\alpha$" is monitored here. Then, if the value is maintained in "$0.8<\alpha\leqq 1.0$", the determination is made an "output stabilized" state at a step 4325. If the value is maintained in "$0.6<\alpha\leqq 0.8$", the determination is made an "output not stabilized" state at a step 4326. If the value is maintained in "$\alpha\leqq 0.6$", the determination is made an "inactive" state at a step 4327. In the aforementioned embodiment, the auto- regressive moving-average model whose model order is 1 and has the dead-time P (P=3) is approximately used for the model of the system for controlling the air-fuel ratio $\lambda$ of the internal combustion engine E. Thus, the above-mentioned detected air-fuel ratio $\lambda$ is delayed by a part corresponding to three revolutions. As the result, assuming here that an engine rotation number is represented by i, the determination equation also becomes, to be exact, the following equation.

$$|\{\lambda(i+3)-\lambda BF(i+3)\}/\{FAF(i)-FAFBF(i)\}|=\alpha$$

Additionally, in the above-mentioned step 4321, whether the internal combustion engine E is maintained in the same operating condition or not may be determined by comparing the preceding and following sampling values respectively regarding the engine rotation number and an intake pipe pressure. If these values are close to each other, the determination is made that the internal combustion engine E is maintained in the same operating condition.

Furthermore, at the aforementioned step 4322, whether or not the apparatus is conditioned to be in a feedback state may be determined by whether the previous feedback condition is satisfied or not (refer to the step 410 of FIG. 4).

In case the determination is made "NO" at these steps 4321 or 4322, then, the previous determination result as the determination routine is returned as processing of a step 4328.

With such a determination method, whether or not the air-fuel ratio sensor 160 is stabilized and maintained in the air-fuel ratio detectable state may be also determined in very high reliability.

Figure 8:
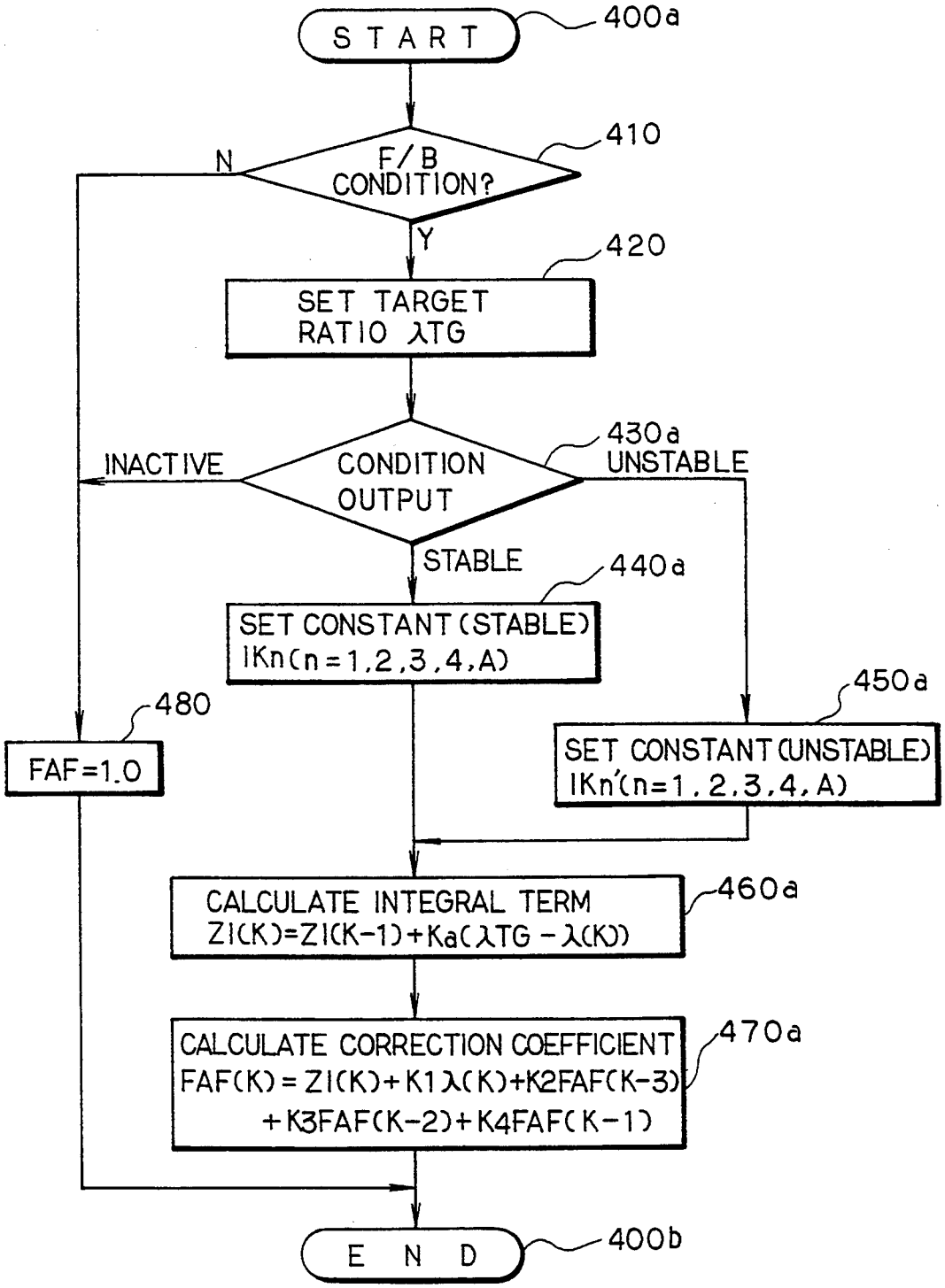
FIG. 8 is a flow chart showing a detailed processing regarding setting procedure of an air-fuel ratio correction coefficient in a further embodiment of the invention.

Further, the method shown in FIG. 8 is also only one example as the detailed processing for obtaining the air-fuel ratio correction coefficient. With respect to for instance setting of the target air-fuel ratio, the target air-fuel ratio may be also set in any point of the same flow chart before it is used in calculation of the integral term or the like.

As described above, according to the second aspect of the invention, calculation of the air-fuel ratio correction coefficient based on the dynamic relationship between the supplied fuel quantity and the detected air-fuel ratio is performed in best conformity with a state of air-fuel ratio detection means on each occasion. And besides the air-fuel ratio feedback control, based on the modern control theory, which is rich in flexibility and excellent in response characteristics may be suitably maintained in any of cases.

Furthermore, according to the second second aspect of the invention, the starting timing of the feedback may be advanced as compared with the conventional air-fuel ratio control apparatus described in the beginning of the specification. As a result, it becomes possible to more facilitate decrease of emission of harmful components in the exhaust gas under the proper air-fuel ratio control.

The present invention described hereinabove should not be limited to the foregoing embodiments but may be modified in various ways without departing from the spirit of the invention.

What is claimed is:

1. An air-fuel ratio control apparatus for an internal combustion engine, comprising:

air-fuel ratio detecting means for detecting an actual air-fuel ratio of an air-fuel mixture supplied to said engine;

target air-fuel ratio setting means for setting a target air-fuel ratio ($\lambda$TG) of said engine;

correction coefficient calculating means for setting an optimal feedback gain on the basis of a predetermined dynamic model of said engine and for calculating the coeeficient in accordance with said predetermined optimal feedback gain so that said actual air-fuel ratio becomes equal to said target air-fuel ratio;

fuel supply amount determining means for determining a fuel supply amount to said engine on the basis of the calculated correction coefficient;

state determining means for determining, based on output condition of said air-fuel ratio detecting means, whether said engine is in a state where said optimal feedback gain for said dynamic model may be used or not; and control suppressing means for suppressing a control response speed of said coefficient calculating means in response to determination of non-usableness of said optimal feedback gain, said control suppressing means including switching means for switching to a control mode where either one of a lower feedback gain for said dynamic model and an integral-and-proportional control is used.

2. An air-fuel ratio control apparatus for an internal combustion engine having fuel supply means for supplying fuel into air sucked into the internal combustion engine so as to form an air-fuel mixture to be supplied to the internal combustion engine, said apparatus comprising:

air-fuel ratio detection means for detecting an air-fuel ratio of the air-fuel mixture on a basis of exhaust gas of the internal combustion engine;

air-fuel ratio control means for obtaining an air-fuel ratio correction coefficient required on each occasion as it performs feedback for controlling the detected air-fuel ratio toward a target air-fuel ratio on a basis of a dynamic model set in approximation with a controlled object from said fuel supply means to said air-fuel ratio detection means;

fuel supply quantity control means for controlling a fuel quantity, on a basis of the obtained air-fuel ratio correction coefficient;

detected value determination means for monitoring a detected value of the air-fuel ratio detected by said air-fuel ratio detection means and for determining whether or not the detected value exists in a predetermined range wherein the set control model may be maintained; and said air-fuel ratio control means including means for obtaining the air-fuel ratio correction coefficient as it performs the feedback at a low gain for converging the feedback slowly, when said detected value determination means determines that the detected value is out of the predetermined range.

3. An air-fuel ratio control apparatus for an internal combustion engine as claimed in claim 2, wherein said detected value determination means determines that a range wherein the detected value of said air-fuel ratio detection means takes a linear value is in the predetermined range.

4. An air-fuel ratio control apparatus for an internal combustion engine as claimed in claim 2, wherein said air-fuel ratio control means includes:

means for obtaining an air-fuel ratio correction coefficient corresponding to a target air-fuel ratio set in accordance with a state of the internal combustion engine on each occasion as it performs state feedback for controlling the detected air-fuel ratio toward the target air-fuel ratio;

first operation means for obtaining the air-fuel ratio correction coefficient at an optimal feedback gain set so as to converge the state feedback at a high speed; and second operation means for obtaining the air-fuel ratio correction coefficient at a low feedback gain set so as to converge the state feedback slowly; and said air-fuel ratio control means performing selectively calculation of the air-fuel ratio correction coefficients, in accordance with the determined result of said detected value determination means.

5. An air-fuel ratio control apparatus for an internal combustion engine as claimed in claim 2, wherein said air-fuel ratio-control means includes:

first operation means for obtaining an air-fuel ratio correction coefficient corresponding to a target air-fuel ratio set in accordance with a state of the internal combustion engine on each occasion as it performs state feedback for controlling the detected air-fuel ratio toward the target air-fuel ratio; and second operation means for obtaining the corresponding air-fuel ratio correction coefficient with proportional-and-integral processing wherein the target air-fuel ratio is predetermined in a specified value; and said air-fuel ratio control means performing selectively calculation of the air-fuel ratio correction coefficients given in accordance with the determined result of said detected value determination means.

6. An air-fuel ratio control apparatus for an internal combustion engine having fuel supply means for supplying fuel into air sucked into the internal combustion engine so as to form an air-fuel mixture to be supplied to the internal combustion engine, said apparatus comprising:

air-fuel ratio detection means for detecting an air-fuel ratio of the air-fuel mixture on a basis of exhaust gas of the internal combustion engine;

air-fuel ratio control means for obtaining an air-fuel ratio correction coefficient required on each occasion as it performs state feedback for controlling the detected air-fuel ratio-toward a target air-fuel ratio on a basis of a dynamic model set in approximation with a controlled object from said fuel supply means to said air-fuel ratio detection means;

fuel supply quantity control means for controlling a fuel quantity, on a basis of the obtained air-fuel ratio correction coefficient;

determination means for determining whether or not said air-fuel ratio detection means is maintained stably in an air-fuel ratio detectable state;

memory means for setting and storing therein, as the dynamic model, optimal feedback gains for converging the state feedback most quickly, corresponding to respective states when said air-fuel ratio detection means is maintained stably in the air-fuel ratio detectable state and is not maintained so;

model switch-over means for selectively reading out these set and stored optimal feedback gains in accordance with the determined result of said determination means; and said air-fuel ratio control means obtaining the air-fuel ratio correction coefficient on a basis of the optimal feedback gain read out selectively from said model switch-over means.

7. An air-fuel ratio control apparatus for an internal combustion engine as claimed in claim 6, wherein said determination means determines that said air-fuel ratio detection means is maintained stably in the air-fuel ratio detectable state, on a basis of a logic product condition of that a temperature of said air-fuel ratio detection means reaches a predetermined temperature and that a predetermined time lapses after reach of the temperature to the predetermined temperature.

8. An air-fuel ratio control apparatus for an internal combustion engine as claimed in claim 6, wherein said determination means determines that said air-fuel ratio detection means is maintained stably in the air-fuel ratio detectable state, under a condition that dynamic relationship between the controlled fuel supply quantity and the detected air-fuel ratio is maintained.

* * * * *